US009434087B2

(12) United States Patent
Beakler et al.

(10) Patent No.: US 9,434,087 B2
(45) **Date of Patent: *Sep. 6, 2016**

(54) APPARATUS AND METHOD FOR DISTRESSING AN EDGE OF A MATERIAL

(75) Inventors: Brian W. Beakler, York, PA (US); Matthew S. Myers, Lititz, PA (US); Kenneth O. Beck, Manheim, PA (US); Dave M. Warholic, Lebanon, PA (US)

(73) Assignee: AFI Licensing LLC, Lancaster, PA (US)

( * ) Notice: Subject to any disclaimer, the term of this patent is extended or adjusted under 35 U.S.C. 154(b) by 1185 days.

This patent is subject to a terminal disclaimer.

(21) Appl. No.: 13/442,960

(22) Filed: Apr. 10, 2012

(65) Prior Publication Data

US 2013/0263709 A1 Oct. 10, 2013

(51) Int. Cl.

| | |
|---|---|
| ***B27D 5/00*** | (2006.01) |
| ***B27G 17/04*** | (2006.01) |
| *B26D 3/02* | (2006.01) |
| *B26D 3/06* | (2006.01) |

(52) U.S. Cl.

CPC ..... *B27D 5/006* (2013.01); *B27G 17/04* (2013.01); *B26D 3/02* (2013.01); *B26D 3/06* (2013.01); *Y10T 83/04* (2015.04); *Y10T 83/889* (2015.04)

(58) Field of Classification Search

CPC ..... B27M 3/00; B27M 3/08; B27G 17/02; B27G 17/025; B27G 17/04; B27G 17/06; B27C 1/02; B27C 1/002; B27C 1/10; B27D 5/00; B27D 5/006; B26D 3/02; B26D 3/06; B26D 3/08

See application file for complete search history.

(56) References Cited

U.S. PATENT DOCUMENTS

| | | | | |
|---|---|---|---|---|
| 3,371,417 | A | 3/1968 | Leibow | |
| 3,550,322 | A | 12/1970 | Rajnik et al. | |
| 3,756,295 | A | 9/1973 | Halop | |
| 3,916,965 | A | 11/1975 | Attridge et al. | |
| 3,946,474 | A | 3/1976 | Hahn et al. | |
| 3,990,147 | A | 11/1976 | Gill et al. | |
| 5,058,641 | A | 10/1991 | Giles | |
| 5,212,870 | A | 5/1993 | Chi | |
| 5,353,507 | A | 10/1994 | Lee et al. | |
| 5,778,951 | A * | 7/1998 | Huitsing | B23Q 9/0085 144/135.3 |
| 6,076,574 | A * | 6/2000 | Fadyk | B27C 7/00 142/13 |
| 6,119,741 | A | 9/2000 | Rowe et al. | |
| 6,644,369 | B1 | 11/2003 | Chiang | |
| 6,660,333 | B2 | 12/2003 | Frame | |

(Continued)

FOREIGN PATENT DOCUMENTS

| | | |
|---|---|---|
| CN | 1053384 A | 7/1991 |
| CN | 2794739 Y | 7/2006 |

(Continued)

OTHER PUBLICATIONS

Search Report for corresponding CN Application No. 201380018751X mailed Sep. 3, 2015.

(Continued)

*Primary Examiner* — Matthew G Katcoff

(57) ABSTRACT

An apparatus including a support for supporting a material having at least one edge, an edge cutter head, and an edge cutter head support for supporting the edge cutter head. In response to the edge cutter head and the at least one edge of the material being brought into cutting contact and moved relative to each other, a resulting portion of the at least one edge of the material is distressed.

19 Claims, 2 Drawing Sheets

(56) References Cited

U.S. PATENT DOCUMENTS

| | | | | |
|---|---|---|---|---|
| 6,835,029 | B2 | 12/2004 | Salzer | |
| 6,978,814 | B2 | 12/2005 | Van Capelleveen | |
| 7,409,972 | B2 * | 8/2008 | Haapasalo | B27G 13/04 144/174 |
| 7,685,913 | B2 * | 3/2010 | Roetker | B26D 3/02 83/694 |
| 7,861,753 | B2 | 1/2011 | Walker | |
| 7,886,784 | B2 * | 2/2011 | McFadden | B23Q 35/102 144/144.1 |
| 8,297,157 | B1 | 10/2012 | Miller et al. | |
| 2004/0206218 | A1 | 10/2004 | Nybo | |
| 2009/0159156 | A1 | 6/2009 | Walker | |
| 2009/0223600 | A1 | 9/2009 | Tappan | |
| 2009/0277537 | A1 | 11/2009 | Hahn | |
| 2011/0067782 | A1 | 3/2011 | Walker | |
| 2011/0186180 | A1 | 8/2011 | Peronto | |
| 2012/0067190 | A1 | 3/2012 | Tseng et al. | |

FOREIGN PATENT DOCUMENTS

| | | | |
|---|---|---|---|
| CN | 2908033 | Y | 6/2007 |
| CN | 101161410 | A | 4/2008 |
| DE | 1967423 | | 8/1967 |
| DE | 20121017 | | 12/2001 |
| WO | 2007148184 | A2 | 12/2007 |
| WO | 2009085684 | A1 | 7/2009 |

OTHER PUBLICATIONS

Corresponding PCT/US2013/035938 Search Report dated Oct. 4, 2013.

* cited by examiner

APPARATUS AND METHOD FOR DISTRESSING AN EDGE OF A MATERIAL

FIELD OF THE INVENTION

The present invention relates to cutting apparatus, and more specifically, the present invention relates to cutting apparatus that are configured to distress an edge of a material.

BACKGROUND OF THE INVENTION

It has become fashionable to subject furniture and other objects/fixtures or surfaces of walls or flooring of a structure, such as a residence to a design style or technique sometimes referred to as distressing or antiquing. These design styles are intended to "age" the surface of the item or object treated to achieve a unique and/or rustic look. In one aspect of this design style, the surface of the item may be subjected to operations such as sanding, denting, and/or scraping. Typically these types of operations would be performed on furniture or other items, including walls or flooring that are composed of a cellulose-containing material, such as wood and composite board to produce a distressed surface.

Aspects of a distressed surface can include random irregularities formed in the surface of a material, such as variations relating to depth, width and length of the formed surface irregularity by a tool brought into contact with the material surface, as well as random locations along the surface of the material being scraped. In addition, imperfections are typically desirable, and can occur in response to variations, especially abrupt changes, in mechanical properties of a material having a surface to be distressed. Such changes or variations in mechanical properties could relate to density or hardness of the material. Examples include "knots", also referred to as burls and changes in grain direction, such as commonly associated with wood or other cellulose-containing materials. The desirable appearance of a material surface variation such as a burl, for example, would typically exhibit discontinuities, sometimes referred to as "chattering", such as formed by a scraping tool in the material surface both prior to and subsequent to a scraping tool encountering the burl.

Known constructions of apparatus have been devised in an attempt to produce materials having the desired aspects associated with a distressed material surface. Such constructions, have included sanding heads having discontinuities formed therein, molded heads that are placed in a pressurized contact with a material surface, as well as embossing drums or plates. However, all known apparatus have failed to produce the desired features associated with a distressed material surface.

In addition, in order for distressed surfaces to have the desired continuity and consistency, exposed outwardly extending or protruding edges of the distressed surfaces must also be distressed, versus having straight, uniform beveled edges.

An edge cutting apparatus that can produce the desired features associated with a distressed edge of a material having an adjacent, similarly distressed surface would be desirable in the art.

BRIEF DESCRIPTION OF THE INVENTION

According to an embodiment, an apparatus includes a support for supporting a material having at least one edge, an edge cutter head, and an edge cutter head support for supporting the edge cutter head. In response to the edge cutter head and the at least one edge of the material being brought into cutting contact and moved relative to each other, a resulting portion of the at least one edge of the material is distressed.

According to another embodiment, an apparatus includes a support for supporting a material having at least one edge, an edge cutter head including a pivotable blade holder, and an edge cutter head support for supporting the edge cutter head. In response to the edge cutter head and the at least one edge of the material being brought into cutting contact and moved relative to each other, a resulting portion of the at least one edge of the material is distressed.

According to another embodiment, a method for distressing an edge of a material includes providing a support for supporting a material having at least one edge, an edge cutter head and an edge cutter head support for supporting the edge cutter head. The method further includes directing the blade and the at least one edge into cutting contact and moving at least one of the blade and the at least one edge relative to each other.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is an edge cutter head for distressing at least one edge of a material having a distressed surface such as by cutting contact, which is intended to include scraping. Embodiments of the present disclosure permit fabrication of materials having distressed edges not previously available. The edge cutter head is configured to be movably supported relative to an edge of the material, resulting in a desired distressed appearance along the edge of the material, or distressed edge. It is intended that the term cutting contact include scraping, i.e., that the blade is removing shavings and/or chips from the edge of the material.

For purposes of the disclosure, each of a distressed surface and a distressed edge is intended to exhibit a number of characteristics or aspects. For example, a distressed surface or material surface having a distressed appearance or a distressed edge or edge surface having a distressed appearance or edge of the material being distressed or the like is intended to include random irregularities formed in the surface or edge of a material. These irregularities include variations relating to depth, width and length of the formed surface or edge irregularity. At least one embodiment of an edge cutter head of the present disclosure is configured to be brought into cutting contact with an edge of a material surface to form a distressed edge, the distressed edge including random locations along the surface of the material being distressed, such as by scraping. In addition, each of a distressed surface and a distressed edge is intended to include imperfections that may occur in response to variations, especially abrupt changes, in physical properties of a material having a surface or an edge to be distressed. Such changes or variations in mechanical properties could relate to density or hardness of the material. Examples include knots, and changes in grain direction, such as commonly associated with wood. Similar to a distressed surface, for a distressed edge, the desirable appearance of a material surface variation such as a burl, for example, would typically exhibit discontinuities, sometimes referred to as "chattering", such as formed by an embodiment of a blade of the present disclosure. The discontinuities would be manifested in the material surface, including edges of the material at locations both prior to and subsequent to an embodiment of a blade of the present disclosure encountering the burl. In other words, desirable aspects and attributes of a distressed surface are intended to also be applicable for a distressed edge.

It is to be appreciated that another material may include cellulose-containing materials, such as composite board.

Figure 1:
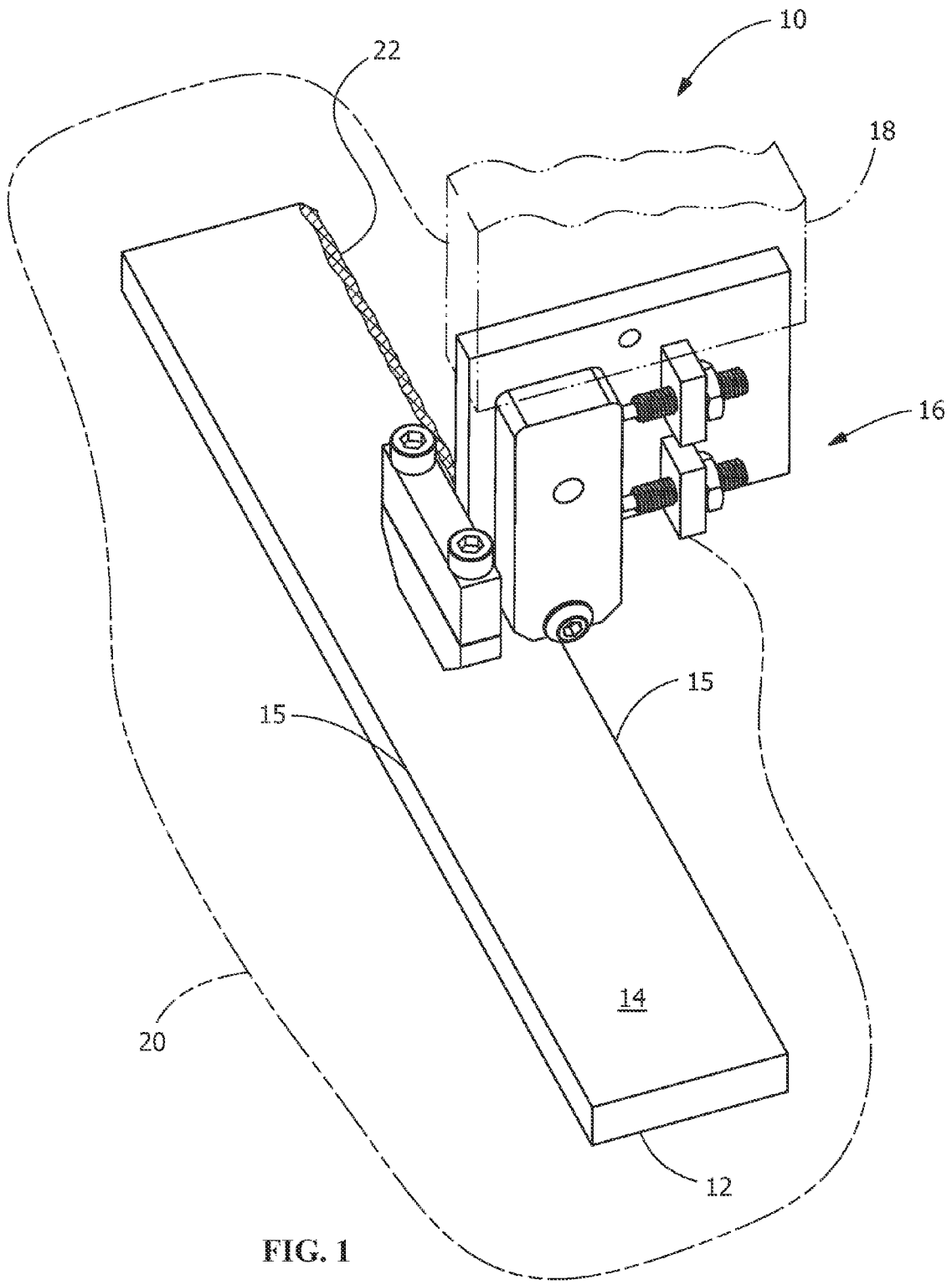
FIG. 1 illustrates a perspective view of an exemplary apparatus according to an embodiment of the disclosure.

As shown in FIG. 1, an apparatus 10 of the present disclosure includes an edge cutter head 16 supported by an edge cutter head support 18. A material 12, such as a board, includes a surface 14 that is supported by a material support 20. As further shown in FIG. 1, material 12 includes a pair of opposed edges 15 separated by surface 14. In one embodiment, edge cutter head support 18 and material support 20 are interconnected. In use, in response to at least one of edge cutter head 16 and a corresponding edge 15 of material 12 being brought into cutting contact and moved relative to each other, a resulting portion of edge 15 has a distressed appearance or distressed edge 22. For purposes of the present disclosure, the term cutter head, as it pertains to a blade associated with edge cutter head 16 is also intended to include abrading contact, such as scraping edge 15 of material 12.

Figure 2:
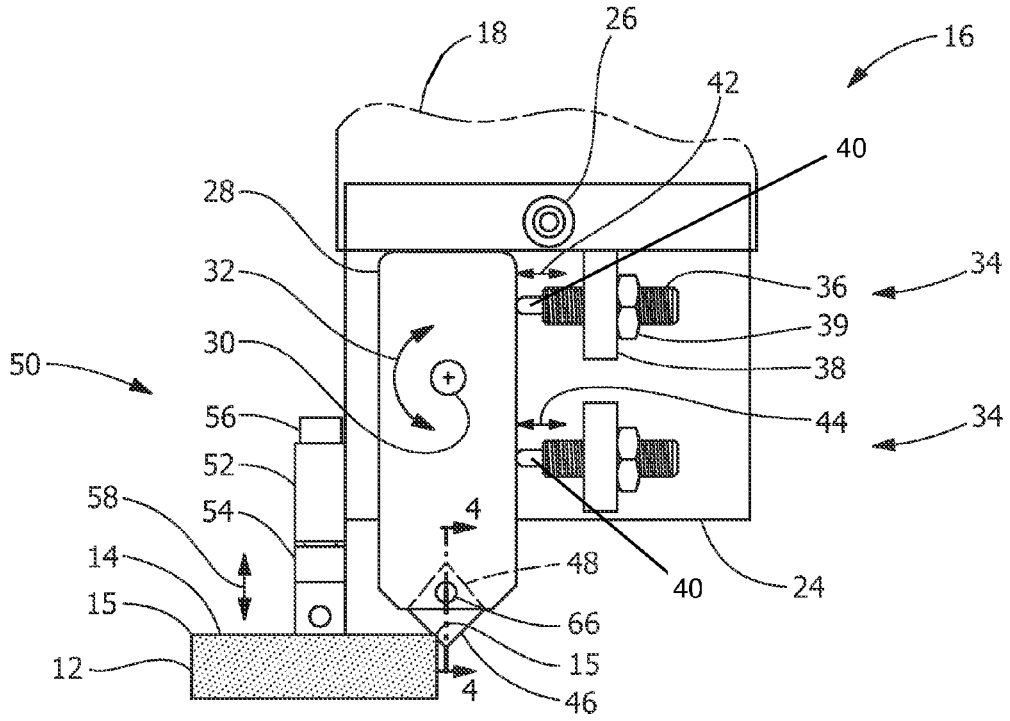
FIG. 2 illustrates an end view of an edge cutter head of the apparatus of FIG. 1, according to an embodiment of the disclosure.
Figure 3:
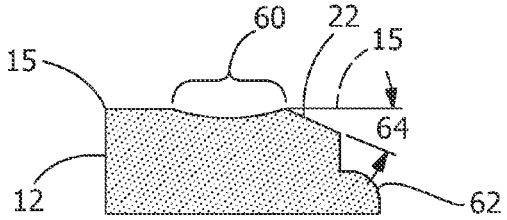
FIG. 3 illustrates an end view of a material subsequent to abrading contact with an apparatus according to an embodiment of the disclosure.
Figure 4:
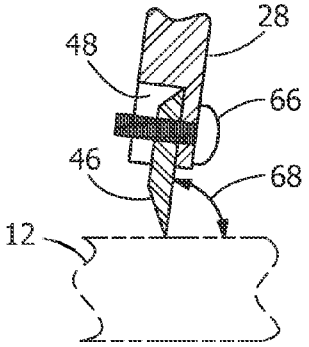
FIG. 4 illustrates a cross-section taken along line 4-4 from FIG. 2 according to an embodiment of the disclosure.

As shown in FIGS. 2-4, edge cutter head 16 includes a base 24 that is secured to edge cutter head support 18 by a fastener 26, such as a quick release fastener. A blade holder 28 is pivotably secured to base 24 such as by a pivot 30. A pair of lugs 38 each support a plunger 34 that permits an amount of rotational movement 32 about an axis corresponding to pivot 30. Plunger 34 includes a threaded sleeve 36 threadedly engaging a corresponding threaded opening formed in threaded lug 38. A lock nut 39 secures threaded sleeve 36 relative to threaded lug 38. A plunger portion 40 extends from each end of threaded sleeve 36 facing blade holder 28. Plunger portion 40 positioned on one side of pivot 30 may be urged into directional movement 42, while another plunger portion 40 positioned on an opposed side of pivot 30 may be urged into directional movement 44. Plunger portion 40 is movable relative to threaded sleeve 36 by a resilient device (not shown) such as a compression spring. The orientation of blade holder 28 can be selectably set by adjusting the position of plungers 34 with respect to each other. That is, by adjustment of the position of plungers 34, the angular orientation of blade holder 28 relative to surface 14 can be set until a desired bevel angle 64 (FIG. 3) is attained. In one embodiment, one plunger may be used to position the blade holder.

It is to be understood that bevel angle 64 corresponds to the orientation of distressed edge 22 of material 12, such as adjacent to a distressed surface 60 (FIG. 3) upon blade 46 of edge cutter head 16 (FIG. 2) being brought into cutting contact with corresponding edge 15 and moved relative to each other. As further shown in FIG. 3, an optional tongue 62, such as used to form a tongue and groove joint, may extend further laterally outward than distressed edge 22. In one embodiment, bevel angle 64 is between about 10 degrees and about 20 degrees, between about 11 degrees and about 19 degrees, between about 12 degrees and about 18 degrees, between about 13 degrees and about 17 degrees, between about 14 degrees and about 16 degrees, or any suitable range or sub-range thereof. In one embodiment, bevel angle 64 is about 10 degrees, about 11 degrees, about 12 degrees, about 13 degrees, about 14 degrees, about 15 degrees, about 16 degrees, about 17 degrees, about 18 degrees, about 19 degrees, about 20 degrees or any suitable sub-range thereof. In addition, by virtue of blade holder 28 being movably secured, such as being pivotably secured about pivot 30 by movable plungers 34, in response to blade 46 encountering variations, especially abrupt changes in physical properties of a material along or adjacent to an edge 15 to be distressed, blade 46 forms discontinuities, sometimes referred to as "chatter" on each side of such variations, as is desirable when forming a distressed edge 22.

As shown in FIG. 2, the depth of distressed edge 22 (FIG. 3) is controllably set (within the sweep of blade 46 about pivot 30) by depth control device 50 that is secured to base 24 and placed in cutting contact with surface 14 of material 12. Alternately, if the surface of material 12 has already been distressed prior to forming distressed edges, depth control device 50 is placed in cutting contact with distressed surface 60 (FIG. 3) of material 12. Depth control device 50 includes a first portion 52 secured to base 24 and a second portion 54 movably secured to first portion 52, such as by a threaded fastener 56. If the adjustment of depth control device 50 is desired, threaded fastener 56, which is rotatably secured to first portion 52, is rotated in one direction such that second portion 54 is urged in a directional movement 58 away from first portion 52, thereby decreasing the depth of distressed edge 22. Alternately, if threaded fastener 56 is rotated in an opposite direction, second portion 54 is urged in a directional movement 58 toward first portion 52, thereby increasing the depth of distressed edge 22.

As further shown in FIGS. 2 and 4, blade 46 is received and secured in a recess 48 formed in blade holder 28. In addition, a fastener 66 is directed through aligned openings formed in blade holder 28 and blade 46. In one embodiment fastener 66 is a threaded fastener, and the opening in blade 46 is correspondingly threaded to receive fastener 66. In one embodiment, blade 46 is substantially square and contains four cutting edges. Therefore, if one cutting edge of blade 46 becomes dull, a fresh cutting edge may be provided by sufficiently loosening fastener 66 such that blade 46 clears or extends exterior of recess 48 of blade holder 28. Upon blade 46 clearing or extending exterior of recess 48, blade 46 can be rotated 90 degrees (for a square blade having 4 cutting edges) then re-directed into recess 48. If fastener 66 is sufficiently long, blade 46 can be removed from recess 48 and rotated while blade 46 and fastener 66 remain threadedly engaged. Fastener 66 is then sufficiently re-tightened to complete the process for blade replacement. As further shown in FIG. 4, upon installation of blade 46, an acute mount angle 68 subtends between a first surface 74 of blade 46 and surface 14 of material 12. In one embodiment, offset angle 68 is between about 85 degrees and about 90 degrees, about 85 degrees and about 89 degrees, about 85 degrees and about 88 degrees, about 85 degrees and about 87 degrees, about 85 degrees and about 86 degrees, about 86 degrees and about 90 degrees, about 86 degrees and about 89 degrees, about 86 degrees and about 88 degrees, about 86 degrees and about 87 degrees, about 87 degrees and about 90 degrees, about 87 degrees and about 89 degrees, about 87 degrees and about 88 degrees, about 88 degrees and about 90 degrees, about 88 degrees and about 89 degrees, or any suitable sub-range thereof. In another embodiment, mount angle 68 is about 85 degrees, about 86 degrees, about 87 degrees, about 88 degrees, about 89 degrees, about 90 degrees, or any suitable sub-range thereof.

It is to be understood that an apparatus of the present disclosure may include more than one apparatus, such as two apparatus, permitting opposed edges of a board of material to be simultaneously distressed. In another embodiment, more than two apparatus may be utilized.

It is to be understood that the apparatus of the present disclosure may be used to distress an edge of material having three sides (and three edges). In another embodiment, the material may have more than four sides (and more than for edges).

It is also to be understood that blade 46 may contain a different number of cutting edges than four.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus comprising:

a support for supporting a material having a surface and at least one edge;

an edge cutter head comprising a base and a blade holder holding a blade, the blade holder pivotably coupled to the base about a pivot axis, an orientation of the blade holder relative to the surface of the material being selectably set by a pair of plungers located on opposite sides of the pivot axis, each of the plungers comprising a plunger portion adjacent to the blade holder and a resilient device, the resilient device permitting the blade holder to pivot about the pivot axis in response to variations in the material being encountered by the blade;

an edge cutter head support for supporting the edge cutter head; and wherein in response to the blade and the at least one edge of the material being brought into cutting contact and moved relative to each other, a resulting portion of the at least one edge of the material is distressed.

2. The apparatus of claim 1, wherein the pair of plungers comprises a first plunger located above the pivot axis and a second plunger located below the pivot axis.

3. The apparatus of claim 2, wherein the plunger portion of each of the first and second plungers is movable towards and away from the blade holder along an axis that is orthogonal to the pivot axis of the blade holder.

4. The apparatus of claim 3, wherein each of the plungers further comprises a threaded sleeve, the plunger portion movably secured to the threaded sleeve by the resilient device.

5. The apparatus of claim 2, wherein each of the plungers is adjustable.

6. The apparatus of claim 1, wherein the edge cutter head includes a depth control device.

7. The apparatus of claim 6, wherein the depth control device includes a first portion and a second portion.

8. The apparatus of claim 7, wherein depth control is achieved by selectably directing the first portion away from or toward the second portion.

9. The apparatus of claim 1, wherein the blade holder includes a recess to receive the blade.

10. The apparatus of claim 9, wherein the blade includes a plurality of cutting edges.

11. The apparatus of claim 10, wherein the blade has four cutting edges.

12. The apparatus of claim 11, wherein the blade is substantially square.

13. The apparatus of claim 9, wherein the blade includes a first surface separated from the surface of the material by an acute mount angle.

14. The apparatus of claim 13, wherein the acute mount angle is between about 85 degrees and 90 degrees.

15. The apparatus of claim 14, wherein the acute mount angle is about 85 degrees.

16. The apparatus of claim 1, wherein the orientation of the blade holder is selectably set to attain a desired bevel angle on the at least one edge of the material, the desired bevel angle being defined relative to the surface of the material.

17. The apparatus of claim 16, wherein the bevel angle is between about 10 degrees and 20 degrees.

18. An apparatus comprising:

a support for supporting a material having at least one edge;

an edge cutter head including a pivotable blade holder holding a blade, wherein the pivotable blade holder is configured to pivot about a pivot axis;

a pair of plungers located on opposite sides of the pivot axis, each of the plungers comprising a plunger portion in contact with the pivotable blade holder and a resilient device, the resilient device permitting the pivotable blade holder to pivot about the pivot axis in response to variations in the material being encountered by the blade;

an edge cutter head support for supporting the edge cutter head; and wherein in response to the blade and the at least one edge of the material being brought into cutting contact and moved relative to each other, a resulting portion of the at least one edge of the material is distressed.

19. The apparatus of claim 18, wherein the plunger portion of each of the plungers is movable towards and away from the pivotable blade holder along an axis that is orthogonal to the pivot axis of the pivotable blade holder.

* * * * *